United States Patent [19]

Almog

[11] Patent Number: 5,047,306

[45] Date of Patent: Sep. 10, 1991

[54] HUMIDITY TOLERANT CHARGE DIRECTOR COMPOSITIONS

[75] Inventor: Yaacov Almog, Rehovot, Israel

[73] Assignee: Spectrum Sciences B. V., Rotterdam, Netherlands

[21] Appl. No.: 354,121

[22] Filed: May 19, 1989

[51] Int. Cl.[5] ..... G03G 9/13

[52] U.S. Cl. ..... 430/115; 430/137

[58] Field of Search ..... 430/137, 114, 115

[56] References Cited

U.S. PATENT DOCUMENTS

| | | | |
|---|---|---|---|
| 4,631,244 | 12/1986 | Mitchell | 430/137 |
| 4,762,764 | 9/1988 | Ng et al. | 430/115 |
| 4,842,974 | 1/1989 | Landa et al. | 430/137 |
| 4,897,332 | 1/1990 | Gibson et al. | 430/115 |
| 4,923,778 | 5/1990 | Blair | 430/115 |

FOREIGN PATENT DOCUMENTS

| | | |
|---|---|---|
| 0001103 | 6/1979 | European Pat. Off. . |
| 0242806 | 10/1987 | European Pat. Off. . |
| 20157892 | 4/1970 | France . |
| 1285465 | 8/1972 | United Kingdom . |

*Primary Examiner*—John Goodrow

*Attorney, Agent, or Firm*—Sandler, Greenblum & Bernstein

[57] ABSTRACT

A humidity tolerant charge director composition comprises a fine dispersion in a non-polar solvent of a charge direction material comprising a molecular charge director compound and an ionic charge director compound, each being conjugated to a polymer which is insoluble in non-polar organic solvents. The charge director material is prepared by adding to a solution of a molecular charge director compound and an ionic charge director compound in a non-polar organic solvent, a monomer compound capable of polymerizing to form a polymer which is insoluble in said solvent, initiating a polyerization reaction of the monomer compound and allowing the polmerization reaction to progress to completion.

37 Claims, No Drawings

HUMIDITY TOLERANT CHARGE DIRECTOR COMPOSITIONS

FIELD OF THE INVENTION

This invention relates to the field of electrostatic imaging, and more particularly to charge director compositions having improved humidity tolerance.

BACKGROUND OF THE INVENTION

In the art of electrostatic photocopying or photoprinting, a latent electrostatic image is generally produced by first providing a photoconductive imaging surface with a uniform electrostatic charge, e.g. by exposing the imaging surface to a charge corona. The uniform electrostatic charge is then selectively discharged by exposing it to a modulated beam of light corresponding, e.g., to an optical image of an original to be copied, thereby forming an electrostatic charge pattern on the photoconductive imaging surface, i.e. a latent electrostatic image. Depending on the nature of the photoconductive surface, the latent image may have either a positive charge (e.g. on a selenium photoconductor) or a negative charge (e.g. on a cadmium sulfide photoconductor). The latent electrostatic image can then be developed by applying to it oppositely charged pigmented toner particles, which adhere to the undischarged "print" portions of the photoconductive surface to form a toner image which is subsequently transferred by various techniques to a copy sheet (e.g. paper).

In liquid-developed electrostatic imaging, the toner particles are generally dispersed in an insulating non-polar liquid carrier, generally an aliphatic hydrocarbon fraction, which generally has a high-volume resistivity above $10^9$ ohm cm, a dielectric constant below 3.0 and a low vapor pressure (less then 10 torr. at 25° C.). The liquid developer system further comprises so-called charge directors, i.e. compounds capable of imparting to the toner particles an electrical charge of the desired polarity and uniform magnitude so that the particles may be electrophoretically deposited on the photoconductive surface to form a toner image.

In the course of the process, a thin film of the liquid developer is applied to and covers the entire photoconductive imaging surface. The charged toner particles in the liquid developer film migrate to the oppositely-charged areas forming the "print" portions of the latent electrostatic image, thereby forming the toner image and any liquid developer remaining on the photoconductive surface after this stage of the process is recycled back into the liquid developer reservoir.

Charge director molecules play an important role in the above-described developing process in view of their function to control the polarity and charge on the toner particles. Necessarily, counter ions are also created in this process so as to maintain the electrical neutrality of the liquid developer phase as a whole. It is believed that in many liquid developers, the charge director molecules form inverse micelles wherein the polar portions of the charge director molecules are directed inwards to the micelles, while the non-polar portions having the higher affinity to the non-polar liquid carrier, are directed outwards, so as to decrease the overall surface energy of the system. These micelles may solubilise ions generated by the dissociation of the charge director molecules.

The charge director compounds may be classified, in a general manner, into molecular chemical species (hereinafter referred to as "molecular charge directors") and ionic chemical species (hereinafter referred to as "ionic charge directors"). The molecular charge directors are zwitterionic compounds, as exemplified by lecithin, which has proved to be an excellent charge director. The ionic charge directors are mostly metal salts of long-chain organic acids, such as metal soaps or metal salts of sulphonated petroleum hydrocarbons (commercially available under the trade name Metal Petronates).

The choice of a particular charge director for use in a specific liquid developer system, will depend on a comparatively large number of physical characteristics of the charge director compound, inter alia its solubility in the carrier liquid, its chargeability, its high electric field tolerance, its release properties, its time stability, etc. All these characteristics are crucial to achieve high quality imaging, particularly when a large number of impressions are to be produced.

One of the problems encountered in liquid-developed electrostatic imaging is the humidity tolerance of the system, especially at high humidity levels (80–85% relative humidity). It has been observed that some liquid developer systems, when operated in a high humidity environment, suffered from fuzziness of the resulting copies. This problem may be associated with the phenomenon of the so-called "morning sickness", namely that after an electrostatic photocopier machine is left without being operated for a comparatively long period (e.g. overnight or over the weekend), blurry images are obtained and this blurriness or fuzziness persists until after a large number of copies, sometimes a few hundred, are made. Cleaning of the photoconductive imaging surface with solvents, such as isopar, was found to be ineffective in restoring image quality.

The above problems of image fuzziness and morning sickness are believed to be due to the water affinity of the charge director in the liquid developer system. The photoconductive imaging surface is covered by a very thin film of liquid developer containing the charge director. If the charge director tends to solubilise or absorb water, the electric conductance of this layer will increase sufficiently to interfere with the formation of located point charges and allow for lateral conduction, resulting in a fuzzy latent image. The suggested mechanism for the phenomenon of morning sickness is that evaporation of the liquid carrier, (e.g. Isopar) from the aforementioned thin film of liquid developer, leaves a residue containing the charge director on the photoconductive surface and this residue, if hygroscopic, will absorb water from the humid atmosphere, thereby becoming insoluble in isopar. When the electrostatic photocopier is reoperated, the residue does not tend to redissolve easily in the liquid carrier or in other non-polar solvents. The electroconductive residue interferes with the electrostatic imaging process, preventing the formation of localised point charges as explained above.

A typical example of a charge director suffering from the above drawback of sensitivity to humidity, is lecithin which, by most other criteria, is an excellent charge director.

It is accordingly one object of the present invention to provide a charge director material having improved humidity tolerance which, when used in a liquid developer system, is capable of functioning at high hymidity levels without giving rise to the above-mentioned drawbacks of fuzziness and morning sickness.

It is a further object of the invention to provide a process for preparing the above-mentioned improved charge director material.

Another object of the invention is to provide a liquid developer system for use in electrostatic imaging, comprising the above-mentioned improved charge director composition.

DESCRIPTION OF THE INVENTION

The present invention is based on the unexpected finding that the humidity tolerance of a liquid developer system can be considerably improved and the problems of fuzziness and morning sickness be controlled, by using a combination of a molecular charge director with an ionic charge director. For example, it was found that the humidity sensitivity of the charge director lecithin could be considerably reduced by adding from one to two parts by weight of barium sulfosuccinate to 25 parts by weight of lecithin. The addition of four parts by weight of barium sulfosuccinate to 25 parts by weight of lecithin completely eliminated the morning sickness problem. Similar results were obtained with other pairs of molecular and ionic charge directors. Among the ionic charge directors used in these experiments, was basic barium petronate which, when used by itself as the sole charge director, has proven to be essentially stable to humidity, but to possess less than optimal release properties and a poor electrical stability.

It appears from the above findings that the ionic charge director in the combination either decreases the tendency of the molecular charge director to absorb or solubilise water, or interferes in some manner with the penetration of humidity from the atmosphere into the liquid developer layer on the photoconductive surface.

Nevertheless, the use of a combination of a molecular and an ionic charge director compound involves the drawback that the balance between these two materials in the liquid developer system will vary with time, owing to the unequal rates of depletion of the two charge director compounds from the system. The application of liquid developer to the photoconductive surface obviously depletes the overall amount of liquid developer in the reservoir of an electrocopying or electroprinting machine of this type. While the consumption of carrier liquid per copy made is substantially constant, this is not true for the toner particles because the amount thereof utilised per copy varies as a function of the proportional area of the printed portions of the latent image on the photoconductive surface. Since different charge directors have different affinities for the toner particles, it is to be expected that the rate of depletion of the various charge director materials will be different, resulting in a gradual change of the proportions of the molecular and ionic charge directors used in combination in the above-mentioned system. This would have a negative effect on the stability of the electrical characteristics of the liquid developer, in particular its bulk conductivity, which stability is crucial for achieving high and constant image quality.

In accordance with the present invention, the above-mentioned problem is solved by conjugating both the molecular charge director compound and the ionic charge director compound to a polymer which is insoluble in the non-polar liquid carrier. In accordance with the invention, the molecular charge director compound and the ionic charge director compound, both conjugated to such a polymer, will be comprised in the liquid developer system as a very fine dispersion of the polymer particles in the carrier liquid. It has surprisingly been found in accordance with the invention that the conjugation of the molecular and the ionic charge director compounds to the polymer does not interfere with their functions in the liquid developer system, nor does it detract from the quality of the copies produced on the substrate.

Thus, in accordance with one aspect of the invention, there is provided a charge director material comprising a molecular charge director compound and an ionic charge director compound, each being conjugated to a polymer which is insoluble in non-polar organic solvents.

In accordance with another aspect, the invention provides a charge director composition comprising a non-polar organic solvent and, finely dispersed therein, particles of a polymer which is insoluble in said solvent, conjugated with both a molecular charge director compound and an ionic charge director compound.

In accordance with the present invention, the molecular charge director compound and the ionic charge director compound can be conjugated to the polymer by polymerising the corresponding monomer molecules in a suitable non-polar organic solvent in the presence of the molecular and the ionic charge director compounds which are both dissolved in the solvent. This solvent is preferably the same insulating non-polar solvent which is to be used as the carrier liquid in the liquid developer system to which the product charge director material will be added.

In accordance with this further aspect of the invention there is provided a process for producing a charge director material which comprises the steps of:

dissolving a molecular charge director compound and an ionic charge director compound in a non-polar organic solvent;

mixing the solution obtained with a monomer compound capable of polymerising to form a polymer which is insoluble in said solvent;

initiating a polymerisation reaction of said monomer compound, preferably at a temperature from about 50° C. to about 90° C.; and allowing the polymerisation reaction to progress to completion.

In the above process according to the invention, the molecular and/or the ionic charge director compound, comprised in the non-polar solvent, possibly acts as a surfactant for the polymerisation of the monomer compound. It is believed that as the polymerisation reaction progresses, the formed polymer molecules will reach a critical length above which they are insoluble in the non-polar solvent. There results in a very fine dispersion of this insoluble polymer with the charge director compounds conjugated thereto, in the solvent. In case the solvent is the same as the one to be used as carrier liquid, this resulting suspension of the charge director material in the solvent can be diluted as necessary with the carrier liquid and mixed with toner particles to form the liquid developer system. Alternatively, the fine dispersion of charge director material in the solvent can serve as a concentrate for replenishment of the charge director material in the liquid developer reservoir of an electrostatic imaging machine.

The non-polar or organic solvent to be used in the polymerisation process according to the invention can be selected from a wide variety of solvents, including hexane, cyclohexane, isoparaffins, t-butylbenzene, 2,2,4-trimethylpentane and normal paraffins. Preferred solvents are the series of branched-chain aliphatic hydrocarbons and mixtures thereof which are commercially available under the name Isopar (a trademark of the Exxon Corporation). It is preferred to use a non-polar solvent in which the monomer compound is soluble, but its polymer is insoluble.

A large choice of monomer compounds is believed to be available for use in the process of the invention. Preferred monomers are olefinically unsaturated monomers, preferably 1-vinyl-2-pyrrolidine or methyl methacrylate. Other monomers which are believed to be suitable include 2-vinyl pyridine and vinylfuran.

The polymerisation reaction is preferably initiated by the addition of a suitable polymerisation initiator, preferably azobisbutyronitrile. Other polymerisation initiators are benzoyl peroxide, triphenylazobenzene, cumene hydroperoxide and t-butyl peracetate.

As stated above, the polymerisation reaction is preferably carried out at a somewhat elevated temperature, e.g. from about 50° C. to about 90° C. In such cases, a non-polar solvent should be selected which boils at a significantly higher temperature than the polymerisation temperature. Alternatively, the polymerisation reaction can be conducted at the boiling point of the solvent under reflux conditions.

The polymerisation reaction is preferably conducted under an inert atmosphere, e.g. a nitrogen atmosphere.

The present invention will be further illustrated by the following, non-limiting examples.

EXAMPLE 1

A four-necked, 2 liter glass reactor fitted with a mechanical stirrer and a reflux condenser, was charged with 300 g of a 10% lecithin solution in Isopar H and 300 g of a 5% solution of Basic Barium Petronate in Isopar H. The resulting solution was then heated to 95° C. and 6 g of 1-vinyl-2-pyrrolidone were added under stirring followed by 0.6 g of azobisbutyrlonitrile suspended in 10–20 ml of Isopar H. The reaction was allowed to proceed at 95° C. under stirring for 24 hours, in a nitrogen atmosphere.

EXAMPLE 2

The procedure of Example 1 was repeated, except that instead of Basic Barium Petronate there was used Basic Calcium Petronate.

EXAMPLE 3

The procedure of Example 1 was repeated, except that 300 g of a 7.5% solution of Basic Barium Petronate in Isopar H was used instead of the 5% solution of Example 1.

EXAMPLE 4

The procedure of Example 1 was repeated, except that 300 g of a 6.25% solution of Basic Barium Petronate in Isopar H were used instead of the 5% solution of Example 1.

EXAMPLE 5

Preparation of Liquid Developer

Step 1

Black imaging material is prepared as follows: 10 parts by weight of Elvax 5720 (E. I. du Pont), and 5 parts by weight of Isopar L (Exxon) are mixed at low speed in a jacketed double planetary mixer connected to an oil heating unit, for 1 hour, the heating unit being set at 130° C.

A mixture of 2.5 parts by weight of Mogul L carbon black (Cabot) and 5 parts by weight of Isopar L is then added to the mix in the double planetary mixer and the resultant mixture is further mixed for 1 hour at high speed. 20 parts by weight of Isopar L pre-heated to 110° C. are added to the mixer and mixing is continued at high speed for 1 hour.

The heating unit is then disconnected and mixing is continued until the temperature of the mixture drops to 40° C.

Step 2

100 g of the black imaging material prepared in Step 1 above were mixed with 120 g of Isopar L and the mixture was milled for 19 hours in an attritor to obtain a dispersion of particles. The attritted material was dispersed in Isopar H at a solids content of 1.5%.

Step 3

A charge director material prepared in accordance with any one of Examples 1 to 4 was added to the dispersion obtained in Step 2 above at a proportion of about 3% by weight.

EXAMPLE 6

The stability of the ratio of lecithin and Basic Barium Petronate in the charge director material of Example 1 was tested as follows:

(A) A liquid developer was prepared by the procedure of Example 5, using in Step 3 the charge director material obtained by the procedure of Example 1. The concentrations of the lecithin and the Basic Barium Petronate was measured after 1 hour after the addition of the charge director material, and again after further 23 hours. During this period, some of the charge director material is adsorbed by the toner particles in the liquid developer system. The ratio of lecithin to Basic Barium Petronate was found to have changed by 13%, which is within the margin of error of the measurements. This result shows that both the lecithin and the Basic Barium Petronate are adsorbed by the toner particles to substantially equal extents. As expected, the conductivity of the liquid developer system decreased after 23 hours to about 70% of its starting value, due to the adsorption of the charge director on the toner particles.

(B) A Savin electrocopier equipped with Savin 2200 paper was charged with the same liquid developer composition used in test (A) above, comprising the charge director material prepared according to Example 1 above. 5 Test runs of between 1,000 and 2,000 copies each were made with originals having a black coverage of 0%, 5% and 21%. The liquid developer was replenished as necessary. The ratio of lecithin to Basic Barium Petronate in the liquid developer was measured at the beginning and at the end of each run, and was found to change by less than ±17% in an apparently random manner.

EXAMPLE 7

Measurements conducted with the charge director materials of the present invention in Isopar indicated that the charge stability under conditions of high electrical field is good and the conductivity stability with time after dilution is also good.

EXAMPLE 8

A Savin 870 electrostatic copier equipped with Savin 2200 paper was charged with a liquid developer prepared as in in Example 5 above and placed in an environmental chamber at 26.6° C. and 80% relative humidity (R.H.). The conditions were allowed to equilibrate for half an hour and copies were then prepared. The relative humidity was then increased by stages of 5% and the above procedure repeated, until signs of fuzziness of the copies appeared. The results were as follows:

(A) Liquid developer comprising the charge director prepared in accordance with Example 3:

26.6° C; 80% R.H.—Good Images, No Fuzziness
26.6° C.; 85% R.H.—Good Images, No Fuzziness
26.6° C.; 90% R.H.—Good Images, No Fuzziness When the relative humidity was increased to 96%, the first copy was slightly fuzzy (locally) but the fuzziness disappeared in the course of further copying.

(B) Liquid developer comprising the charge director prepared in accordance with Example 4:

26.9° C.; 82% R.H.—Good Images, No Fuzziness
26.9° C.; 85% R.H.—Good Images, No Fuzziness
26.8° C.; 90% R.H.—Signs of Fuzziness; the paper is still very readable.

(C) Liquid developer comprising the charge director prepared in accordance with Example 1:

26.6° C.; 81% R.H.—Good Images, No Fuzziness
26.5° C.; 85.5% R.H.—Good Images, No Fuzziness (after machine was allowed to stand overnight under these conditions)
26.6° C.; 90% R.H.—Starts to show Fuzziness.

(D) Liquid developer comprising lecithin as charge director-control experiment:

26.6° C.; 81.5% R.H.—Fuzzy Images

I claim:

1. A liquid developer including:
a non-polar, organic, carrier liquid;
pigmented toner particles; and
a charge director material comprising a zwitterionic charge director compound and an ionic charge director compound each being conjugated to a polymer which is insoluble in said liquid.

2. A liquid developer according to claim 1, wherein the zwitterionic charge director compound is lecithin.

3. A liquid developer according to claim 1, wherein the ionic charge director compound is basic barium petronate.

4. A liquid developer according to claim 1, wherein the ionic charge director compound is basic calcium petronate.

5. A liquid developer according to claim 1, wherein the polymer is polyvinylpyrrolidone.

6. A liquid developer according to claim 1, wherein the ratio of the zwitterionic charge director compound to the ionic charge director compound is from about 2:1 to about 1:1 by weight.

7. A process for producing a charge director material which comprises the steps of:
dissolving a zwitterionic charge director compound and an ionic charge director compound in a non-polar organic liquid;
mixing the solution obtained with a monomer compound capable of polymerising to form a polymer which is insoluble in said liquid;
initiating a polymerisation reaction of said monomer compound; and
allowing the polymerisation reaction to progress to completion.

8. A process according to claim 7, wherein the zwitterionic charge director compound is lecithin.

9. A process according to claim 7, wherein the ionic charge director compound is basic barium petronate.

10. A process according to claim 7, wherein the ionic charge director compound is basic calcium petronate.

11. A process according to claim 7, wherein the monomer is 1-vinyl-2-pyrrolidone.

12. A process according to claim 7, wherein the non-polar organic liquid is a branched-chain aliphatic hydrocarbon or a mixture of such hydrocarbons.

13. A process according to claim 7, wherein the non-polar organic liquid is an isoparaffinic hydrocarbon fraction having a boiling range above about 155° C.

14. A process according to claim 7, wherein the non-polar organic liquid is Isopar H or Isopar L.

15. A process according to claim 7, wherein the polymerization is carried out at a temperature from about 50° C. to about 90° C.

16. A process according to claim 7, wherein the polymerization is initiated by the addition of azobisbutyronitrille.

17. A process according to claim 7, wherein the zwitterionic charge director compound and the ionic charge director compound are used in a ratio of from about 2:1 to about 1:1 by weight.

18. A charge director composition prepared according to the process of claim 7 and comprising a non-polar organic liquid and, finely dispersed therein, particles of a polymer which is insoluble in said liquid, conjugated with both a zwitterionic charge director compound and an ionic charge director compound.

19. A charge director composition according to claim 18 wherein the polymer is polyvinylpyrrolidone.

20. A charge director composition according to claim 18 wherein the zwitterionic charge director compound is lecithin.

21. A charge director composition according to claim 18 wherein the ionic charge director compound is basic barium petronate.

22. A charge director composition according to claim 18 wherein the ionic charge director compound is basic calcium petronate.

23. A charge director composition according to claim 18 wherein the ratio of the zwitterionic charge director compound to the ionic charge director compound is from about 2:1 to about 1:1 by weight.

24. A charge director composition according to claim 18 wherein the non-polar organic liquid is a branched-chain aliphatic hydrocarbon or a mixture of such hydrocarbons.

25. A charge director composition according to claim 18 wherein the non-polar organic liquid is an isoparaffinic hydrocarbon fraction having a boiling range above about 155° C.

26. A charge director composition according to claim 18 wherein the non-polar organic solvent is Isopar H or Isopar L.

27. For use in electrostatic imaging, a liquid developer system comprising:
an insulating non-polar carrier liquid;
toner particles dispersed in said carrier liquid; and
a charge director material prepared according to the process of claim 7 dispersed in said carrier liquid.

28. An electrostatic imaging process comprising the steps of:

forming a latent electrostatic image on a surface;

applying to said surface electrically charged toner particles from a liquid developer system according to claim 27, thereby to form a toner image on said surface; and transferring the resulting toner image to a substrate.

29. An electrostatic imaging process comprising the steps of:

electrostatically charging a photoconductive surface;

exposing said photoconductive surface to an optical image thereby forming a latent electrostatic image on said photoconductive surface;

applying to said photoconductive surface electrically charged toner particles from a liquid developer system according to claim 27, thereby to form a toner image on said photoconductive surface; and transferring the resulting toner image to a copy sheet substrate.

30. A method for developing a latent electrostatic image in a liquid-developed electrostatic imaging process, which comprises the use of a liquid developer system according to claim 27.

31. A liquid-developed electrocopying or electroprinting apparatus comprising a liquid developer system according to claim 27.

32. A liquid developer according to claim 1 wherein said zwitterionic charge director compound is lecithin and said ionic charge director compound is barium petronate or calcium petronate.

33. A liquid developer according to claim 5 wherein said zwitterionic charge director compound is lecithin and said ionic charge director compound is barium petronate or calcium petronate.

34. A process according to claim 7 wherein said zwitterionic charge director compound is lecithin and said ionic charge director compound is barium petronate or calcium petronate.

35. A process according to claim 11 wherein said zwitterionic charge director compound is lecithin and said ionic charge director compound is barium petronate or calcium petronate.

36. A charge director composition according to claim 18 wherein said zwitterionic charge director compound is lecithin and said ionic charge director compound is barium petronate or calcium petronate.

37. A charge director composition according to claim 19 wherein said zwitterionic charge director compound is lecithin and said ionic charge director compound is barium petronate or calcium petronate.

* * * * *